US009452880B2

(12) United States Patent
Thomas et al.

(10) Patent No.: US 9,452,880 B2
(45) Date of Patent: Sep. 27, 2016

(54) FLEXITANK DESIGN

(71) Applicant: PacTec, Inc., Clinton, LA (US)

(72) Inventors: Derrel Thomas, Clinton, LA (US); Michael Schilling, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 0 days.

(21) Appl. No.: 14/073,930

(22) Filed: Nov. 7, 2013

(65) Prior Publication Data

US 2014/0133951 A1 May 15, 2014

Related U.S. Application Data

(63) Continuation of application No. PCT/US2012/037496, filed on May 11, 2012.

(60) Provisional application No. 61/484,757, filed on May 11, 2011.

(51) Int. Cl.
*B65D 88/16* (2006.01)
*B65D 88/22* (2006.01)

(52) U.S. Cl.
CPC ..... *B65D 88/22* (2013.01); *B65D 88/1606* (2013.01); *B65D 88/1631* (2013.01); *B65D 88/1637* (2013.01)

(58) Field of Classification Search
CPC ..... B65D 88/1606; B65D 88/22
USPC ..... 220/1.5, 1.6; 383/119, 903, 113, 109, 383/105
See application file for complete search history.

(56) References Cited

U.S. PATENT DOCUMENTS

| | | | | |
|---|---|---|---|---|
| 4,468,812 | A | 8/1984 | Grosvenor | |
| 4,801,042 | A * | 1/1989 | Hamada et al. | 206/204 |
| 4,875,596 | A * | 10/1989 | Lohse | 220/1.6 |
| 5,193,710 | A * | 3/1993 | Podd, Sr. et al. | 220/1.6 |
| 5,542,563 | A * | 8/1996 | Matias | 220/1.6 |
| 5,595,315 | A * | 1/1997 | Podd et al. | 220/1.5 |
| 5,657,896 | A * | 8/1997 | Matias | 220/1.6 |
| 6,186,713 | B1 * | 2/2001 | Bonerb | 410/100 |
| 6,250,488 | B1 * | 6/2001 | Narahara et al. | 220/1.6 |
| 6,579,009 | B1 * | 6/2003 | Schinasi | 383/119 |
| 6,626,312 | B2 * | 9/2003 | Maturana | 220/1.6 |
| 6,662,962 | B2 * | 12/2003 | Neto | 220/1.6 |
| 7,073,676 | B1 * | 7/2006 | Town | 220/1.6 |
| 7,717,296 | B1 * | 5/2010 | Guthrie | 222/105 |
| 7,967,161 | B2 * | 6/2011 | Townsend | 220/1.6 |
| 7,992,739 | B2 * | 8/2011 | Garcia | 220/7 |
| 8,083,412 | B2 * | 12/2011 | Mino et al. | 383/105 |
| 8,562,212 | B1 * | 10/2013 | Strickland et al. | 383/61.3 |
| 8,690,021 | B2 * | 4/2014 | Asraf | 222/195 |
| 8,777,050 | B1 * | 7/2014 | Joshi et al. | 220/745 |
| 8,894,281 | B2 * | 11/2014 | Town et al. | 383/17 |
| 8,894,282 | B2 * | 11/2014 | Town et al. | 383/17 |
| 2003/0197009 | A1 * | 10/2003 | Mino | 220/1.6 |
| 2005/0040163 | A1 * | 2/2005 | Siegers et al. | 220/1.6 |
| 2006/0175324 | A1 * | 8/2006 | Podd | 220/1.6 |
| 2006/0186117 | A1 * | 8/2006 | Podd | 220/1.6 |

(Continued)

FOREIGN PATENT DOCUMENTS

WO 97/01498 A1 1/1997

*Primary Examiner* — Stephen Castellano
(74) *Attorney, Agent, or Firm* — Jones Walker LLP

(57) ABSTRACT

A flexitank including a bladder and a series of straps positioned across the top of the bladder. The straps may be directly attached to the side or bottom of the flexitank, or may be encircling straps.

6 Claims, 6 Drawing Sheets

(56) References Cited

U.S. PATENT DOCUMENTS

2007/0102428 A1* 5/2007 Eamcharoenying ..... 220/1.6
2007/0267410 A1* 11/2007 Mino et al. ..... 220/1.6
2009/0304308 A1* 12/2009 Townsend et al. ..... 383/24
2010/0122981 A1 5/2010 Sims

* cited by examiner

Top View

Bottom View

FLEXITANK DESIGN

PRIORITY

This application is a continuation application of PCT/US12/37496 entitled "Flexitank Design" filed on May 11, 2012, which claims priority to U.S. Provisional patent No. 61/484,757 filed on May 11, 2011, both of which are hereby incorporated by reference in their entireties.

BACKGROUND OF THE INVENTION

Flexible storage tanks (sometimes referred to as flexitanks) are large bladders used to transport liquids or flowable materials, including highly viscous materials. The bladders are typically constructed of one or more layers or plies of a flexible material (such as two layers of polyethylene (PE) materials, 4-40 mills in thickness), forming an interior water proof (or "fluid proof") portion in which fluids are stored for transport in inter model containers. Flexible means the material can be folded upon itself without fracturing. An example of a prior art flexitank is shown in U.S. Pat. No. 4,468,812. Flexitanks have several advantages—maximum use of space (as opposed, for instance, to drum transport), ease of loading and unloading. They can be made from food-grade materials, and do not have to be cleaned after use, as they are disposable.

A filled bladder is supported by a metal transport container, such as a standard 20 foot sea or railcar transport container, generally referred to as a Sealand Container or a modular transport container. A bulkhead usually is installed in the transport container to keep a filled flexitank from exerting pressure on the container's doors. A typical size for an unfilled flexitank, for use in a 20' long Sealand container is 23.2 feet long by 12.8 feet wide. For reference, assuming a bladder having a length that is greater than its width, the long dimensioned length will be termed "sides" or S while the shorter dimensioned width will be termed "ends" or E. A bladder also has a top portion "T" and a bottom portion "B", referenced in orientation of a filled flexitank (e.g., the bottom portion B is in contact with and supported by the transport container floor.)

The flexitank includes at least one sealable opening into the interior, generally sealed with a valve. The valve is used to fill and discharge the bag. The flexitank may have additional sealable openings as needed for particular applications (such as a vent). The valve may be on the top of the bag, or on the end of the bag, and is positioned on the bag for ease of access for filling and discharging of the flexitank.

To fill a flexitank, the empty bladder is positioned in the interior of a transport container. The bottom (and possibly a portion of the sides) of the container may be lined, for instance, with corrugated paper, boards or other material to protect the flexitank from abrasion induced damage. A fill line is coupled to the valve on the flexitank. If a bulkhead is used, the valve should be accessible through the bulkhead. Product is then pumped into the flexitank, and the flow is metered. Once the desired capacity is reached (usually the rated capacity of the flexitank, for instance, 5000 gallons), the valve is closed and the fill line or hose is removed. A filled flexitank has a known circumference.

During transport, product inside the bladder interior will shift in response to external conditions. In particular, on an ocean going vessel, wave action will translate to fluid movement within the bladder, and the fluids within the flexitank also exhibit wave action. Because the bladder is constructed of pliable elastomeric materials, the exterior of the bladder will stretch and deform in response to fluid movement. This can result in elongation of the bladder, change in circumference, and possible damage to the flexitank and to the transport container.

To reduce stresses on a flexitank, additional layers of material can be added, such as incorporating a non-woven geotextile polypropylene in the construction of the flexitank. See U.S. Pat. No. 6,626,312, hereby incorporated by reference. Another suggested modification has been to strap the bladder itself to the transport container, such as shown in U.S. Pat. No. 6,626,312.

SUMMARY OF THE INVENTION

The inventor herein has found that constructing the flexitank 1 (see FIG. 1) from an inner layer of suitable plastic elastomeric materials (polypropylenes (PP), polyethylene or other suitable polymeric materials) preferably linear low-density polyethylene, and adding an external shell of non-woven material, preferably where the non-woven material has an outer non-absorbent face 6 to deter moisture wicking through the non-woven polymeric material, increases the structural strength of the flexitank. Further, the addition of supporting straps across the top portion of the flexitank, greatly reduces internal wave action, and the resulting stress on the bladder.

DESCRIPTION OF THE PREFERRED EMBODIMENT

Figure 1:
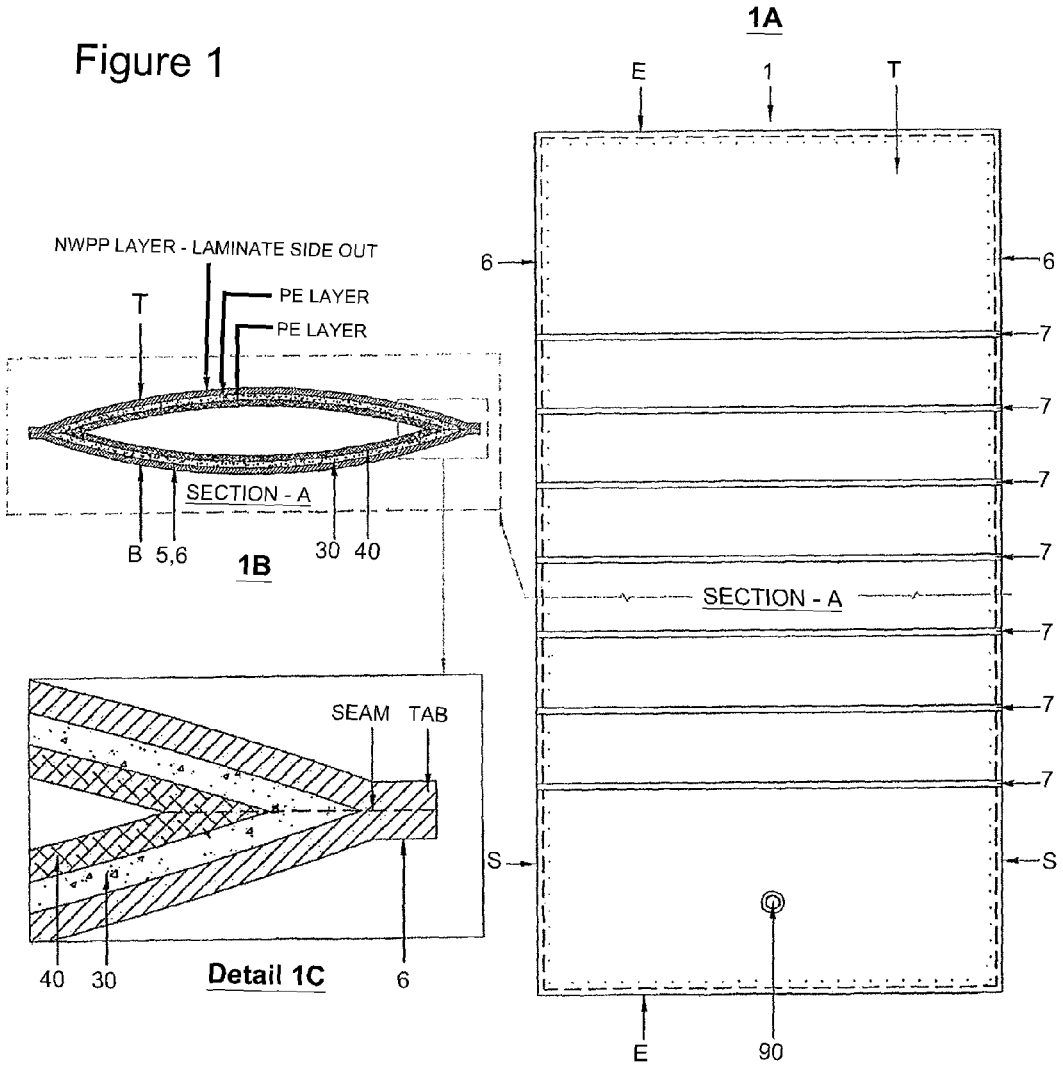
FIG. 1A is a top view of one embodiment of a flexitank.
FIG. 1B is a cross section through the embodiment of FIG. 1A
FIG. 1C is a detail of the tab area of the embodiment shown in FIG. 1A.

One embodiment of the invention is shown in FIG. 1. This embodiment has two plies, each ply forming a bladder container, an inner bladder 40 and an outer bladder 30 (preferably constructed of polyethylene, "PE"), and an outer non-woven shell 5. The inner bladder is water proof (or generally impermeable to the fluid being transported). A preferred non-woven shell material is a polymer nonwoven polypropylene, such as 12 oz., 10 oz. or 8 oz. fabric. The exterior face of the flexitank, is preferably non-wickable, such as constructed from a film of polyethylene (PE) (such as 1 mil and greater thickness), or polypropylene, or other suitable flexible non-absorbent material applied over or to the outer shell of non-woven fabric. The exterior face 6 may be spray applied, heat applied or laminate applied to the non-woven polymeric material. For instance, 4 mil and 8 mil laminate applied polyethylene has been found suitable. The flexitank bladder (or flexible bladder transport container) is constructed in individual layers. The innermost layer or ply forms an inner bladder 40 that is constructed as a single closed bag, such as from PE. Generally, the innermost bladder 40 is formed from a fabric tube (thereby eliminating a seam along the side), and the two ends of the tube are sealed closed, such as by heat sealing, or other sealing method, creating a bladder bag. Prior to sealing one of the ends, an opening 90 is cut in the fabric to form a port opening to accommodate a valve, later described. A valve sleeve is placed in the port opening (later described), and the remaining end of the tube is sealed. A valve body will be sealingly coupled to the valve sleeve.

The second layer or ply is used to form an outer bladder 30, and is also preferably tube formed (thereby again eliminating a seam along the side), either the same length or slightly larger than the innermost bladder. One end is generally sealed, and the innermost bladder 40 inserted into the tube forming the second layer. Again, an opening is cut in the second layer or ply, aligned with the opening in the first layer, and the valve sleeve, in place in the first layer 40, is extended through the second layer 30. The remaining unsealed end in the second ply or layer is then sealed shut, creating the outer bladder 30, with the resulting structure being nested bladders, or a "bladder in a bladder," with the only connection between the two bladders being preferably the valve sleeve positioned through the openings in each ply. Preferably, this second outermost bladder 30 is formed with a 2-4 inch tab of material extending beyond the seam seal line at the two ends of the formed bag.

Finally two sheets of non-woven material (again, preferably with an exterior facing non-absorbent layer), a bottom layer and a top layer, are joined together along the two opposing sides (such as with a sewn or welded seam), forming a tube with seams along the sides. Preferably, the seam is formed with an exterior fabric tab (2-4 inches) that extends beyond the seam. See detail in FIG. 1. The seam in the non-woven does not have to be exactly centered on the side of a filled bladder, but may be offset toward the top or toward the bottom (e.g., the two sheets used to form the shell would not be of equal dimensions). The non-woven tube is sized to accommodate the dual layer bladder bag in the tube's interior. The non-woven fabric sheets will be slightly larger than the size of the bladder bag to account for formation of the tab. An opening is formed in the non-woven tube, aligned with the openings in the bladders so the valve sleeve can extend through all the layers, and the completed two layer bladder is inserted into the interior of the non-woven enclosure, thereby forming an enclosing shell around the inner and outer bladder. The valve sleeve is positioned though this opening, and the valve sleeve assembly is completed, as later described.

The two remaining open ends of the non-woven exterior shell are closed (e.g., sewn or welded closed), preferably sandwiching the tab ends formed in the second layer 30 between the tab ends formed in non-woven exterior fabric. The non-woven tab is preferably formed to be located near the horizontal midline of filled bladder (or lower). In this fashion, the innermost bladder bag is free to move, but the outermost bladder (and intermediary bladders, if more than two layers are used) is coupled to the outer fabric material (at least at one end, preferably at two ends of the outer bladder). If a single bladder layer is used (e.g., only a single bladder bag, the "outer"), preferably it is coupled to the tabs. Other methods can be used to form the external non-woven shell, such as folding a sufficiently long piece of fabric into a "U" shape, and sealing the three remaining ends. Additionally, the flexitank bladder bag may have additional layers, dependent on the application for the flexitank, for instance a Mylar layer (biaxially-oriented polyethylene terephthalate) may be used to prevent UV penetration to the contents stored in the flexitank, thereby forming a three nested bladder bag. An Ethylene Vinyl Alcohol (EVOH) layer maybe be incorporated into a PE layer used for a bladder, as is common in the industry. Additionally, each ply may be coated with a film of desired properties.

In one embodiment, a series of straps 7 can be attached to the extending tabs of the non-woven material that runs along the sides of the flexitank, the straps running from side to side of the flexitank. The straps 7 should be of a sufficient length to allow the strap to lay tightly across the flexitank top, from one side to the other, of a filled bladder. For this reason, the length of the straps are generally similar to the length across the top of the bladder, from tab to tab, based on an unfilled bladder. In this fashion, as the bladder is filled, the straps, will not stretch as much as the bladder or non-woven shell, and begin to constrain the surface of the flexitank adjacent the straps for additional expansion. Preferably, the straps attach to the non-woven outer shell only along the side tabs formed in the non-woven outer shell and are not directly attached to the top portion of the exterior shell in this embodiment, as attaching to the exterior shell across the top portion is labor intensive. Direct attachment means that the strap is attached, such as by a sewn attachment or welding, the material the strap is "attached" to, as opposed to a couple or an indirect attachment. Straps may also be used to join one end of the flexitank to the other (e.g., across the top of the flexitank, from end to end). Instead of attaching the straps directly to the tabs, the tabs may have a series of loops of "belt loops" attached to the tabs, and a strap may be coupled to the belt loop by threading the strap through the belt loops and cinching the strap down tightly when the flexitank is filled (thus allowing for different fill levels of the flexitank). Preferred straps are 2 inch (or larger) woven polyester webbing material rated at around 12,000 lbs. breaking strength. Other material may be used, for instance, nylon, but nylon is more elastic than polyester and is not preferred.

The straps 7 restrain the ability of the flexitank to deform in response to internal fluid movement. When the straps 7 are positioned across the top surface of the flexitank, the straps act as an exterior baffle, restricting the possible internal fluid wave action and thereby reducing deformation of the flexitank. A suitable number of straps 7 across the top of the flexitank can be used, depending on the length of the flexitank. For instance, seven straps, (center strap, and every two feet thereafter along the flexitank's sides) have been found sufficient for a 23' long flexitank.

In another embodiment, the straps can be directly attached to the non-woven material on the bottom portion of the flexitank. In this embodiment, a tab portion is not preferred in the non-woven shell. During transport of a filled flexitank, bladder deformation on the sides and top of the bag is resisted by the straps, and almost no stress is placed on the direct attachment point of the strap to the shell on the bottom of the flexitank, as the bottom of the bag is not subject to the same deformation as the top portion (the deformation of the bottom is restrained by the direct contact with the container floor). Instead of a series of individual straps, a netting of straps (e.g., a series of intersecting straps forming an open weave "fabric" may be used (e.g., distance between intersections of straps is large compared with the strap width—for instance, for two inch straps, intersections may occur (such as, at right angles) every one or two feet). A netting may be used in any embodiment, but is not preferred due to the added expense. The edge of the netting may have a strap perimeter for attachment to the tab portion of the non-woven shell, if present.

Figure 6:
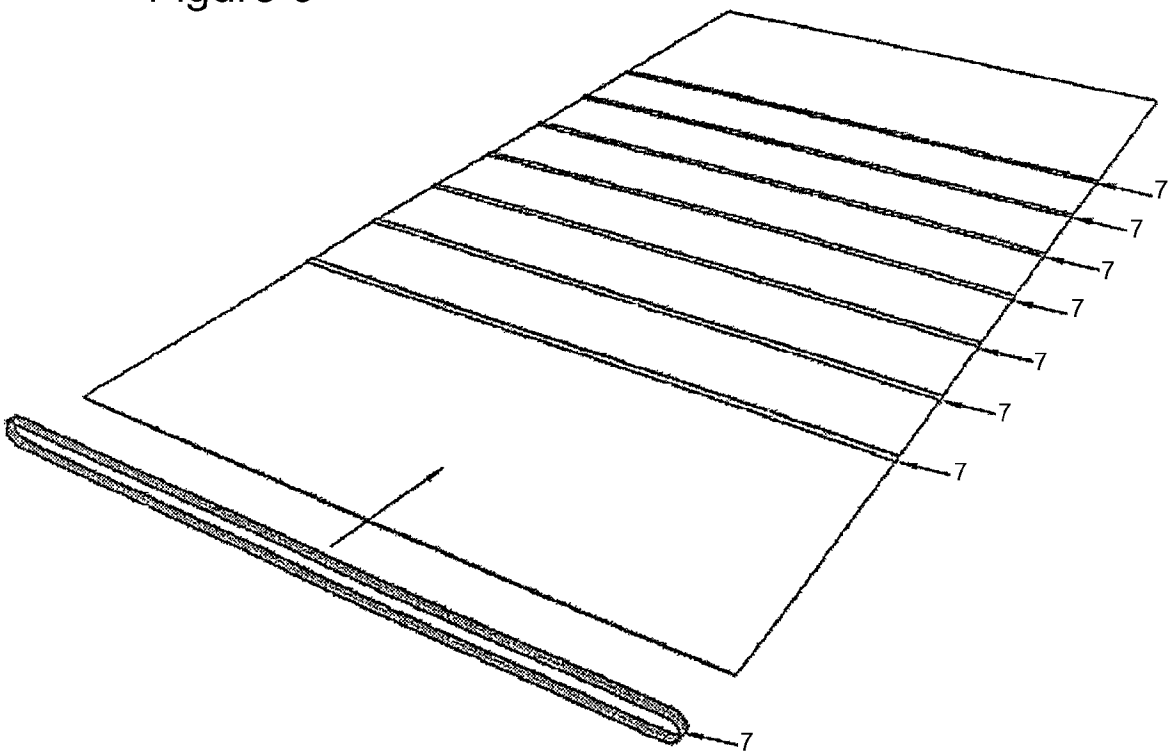
FIG. 6 is an representation of the circular strap embodiment.

Another embodiment is where the straps are not directly attached (such as through a sewn or welded seam) to the flexitank, but the straps form (are formable into) in a closed circle (or a closable circle) sized to accommodate an unfilled flexitank. See FIG. 6. In one embodiment these straps 7 simply encircle a filled bag, and are not directly or indirectly attached, and thus will not result in stress at a strap/flexitank attachment point, as there are no attachment points where the strap is sewn or welded to the non-woven fabric. An encircling strap 7 may be adjustable, such as with a cinch device, or two hoops on one end of the strap to allow tightening of the strap (much like a motorcycle helmet strap). This is not preferred, as it would be necessary to have an operator climb into the transport container with a filled flexitank to tighten the straps. To properly position these straps on the constructed flexitank prior to filling, the straps may be coupled to the flexitank, preferably releasingly coupled, such as with plastic tag pins (such as used on clothing labels) or plastic barbs that may be attached through the strap and non-woven shell, for instance, by use of a tagging gun. This allows the straps to be properly spaced and positioned on the exterior shell, but because the plastic pins are thin (approximately 1 mm diameter), they will shear or break when stressed, and hence, will not create a stress point on the non-woven shell when the bag is deforming. Other indirect attachment means can be used to indirectly couple the straps to the flexitank, such as, for instance, threading the straps through loops attached to the exterior of the flexitank, or more preferably, by coupling the strap to the exterior with a snap, plastic anchor, hook and loop type fasteners, or other coupling that will release if stress is placed on the couple. In this fashion, if flexitank deformation sufficiently strains the outer fabric at a strap couple location, the couple will separate or release prior to damage to the flexitank near the couple location. The purpose of a strap "couple" is primarily to position the straps at suitable locations on the flexitank exterior, so that after filling of the flexitank, the straps are properly positioned across the flexitank top portion, and spaced as desired, to achieve the desired baffling effect. With this embodiment of straps, the tab in the exterior non-woven fabric is not preferred. These circular straps 7 can be utilized with any configuration flexitank, including flexitanks lacking a non-woven exterior shell. If direct attachment is required, a non-woven or woven outer shell is preferred) and the encircling straps may be directly attached to the shell on the bottom of the flexitank, where stress on the attachment points is greatly reduced, as previously described.

Testing has found that the side-to-side straps greatly reduce bladder deformation, and hence, possible bladder rupture. Indeed, use of straps on any configuration flexitank, even one without a non-woven exterior (such as a flexitank with a woven polymeric material outer shell, or a flexitank comprised of only several plies of PE), should reduce bladder deformation. However, it is preferred that, when using straps across the top of the flexitank only, that the flexitank have a non-woven exterior fabric shell, as the non-woven fabric is better adapted to resist tearing when subject to forces that will be present if the straps are directly attached to the non-woven fabric when the bag is undergoing deformation.

Figure 2:
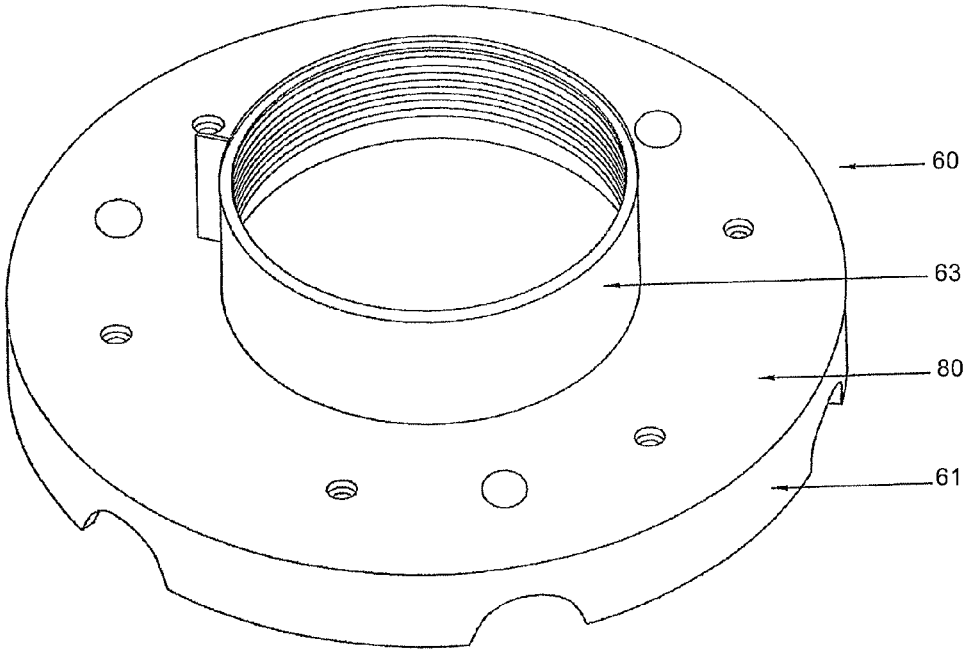
FIG. 2 is a perspective top view of one embodiment of a valve sleeve inner flange.
Figure 3:
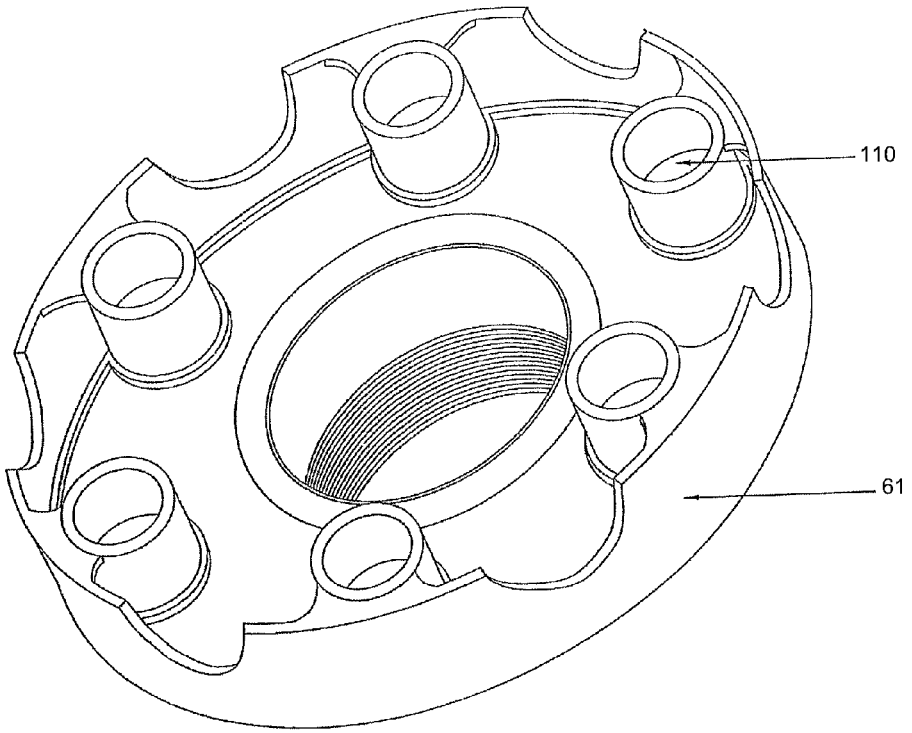
FIG. 3 is a perspective bottom view of the embodiment of a valve sleeve of FIG. 2.

One preferred valve sleeve 60 is shown in FIGS. 2 and 3 and is similar to that shown in US publication 2010/0122981, FIGS. 30A and 30B, and FIGS. 31 and 32 (A-H) (the entire publication is incorporated by reference). The actual valve body will be attached to the valve sleeve. As shown in FIGS. 2 and 3, the valve sleeve 60 has a flange area 61 that extends downwardly (into the interior of the inner bladder) that is scalloped (on the underside, best seen in FIG. 3) for anti-suction, and a center opening with a sleeve extension 63. The anti-suction scalloping in not required if the valve body utilizes included anti-suction features. A gasket 80 is placed between the valve sleeve flange area 61, to seal the completed valve against the innermost bladder. During construction of the flexitank, the sleeve extension 63 is positioned through all the layers of the flexitank. After assembly of the completed flexitank, a top flange 100 (see FIG. 4) is positioned on the exterior of the assembled flexitank, and coupled to the valve sleeve flange area 61, such as with bolts 110 that extend through the two flanges (see FIG. 3). Preferably, sealing gaskets are used around the bolts to prevent leakage through the bolt openings. Other means to attach an outer flange to the valve sleeve's flange area can be used, such as interlocking threading on the two pieces, glue attachment, or other means to couple the sleeve to the outer flange and seal the valve sleeve against the inner bladder.

Figure 4:
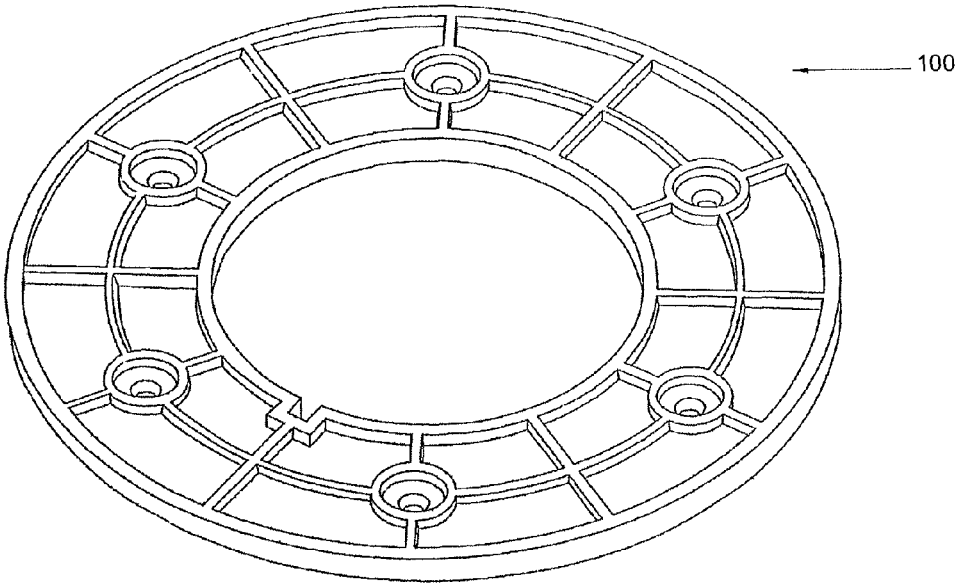
FIG. 4 is a top view of a top flange.
Figure 5:
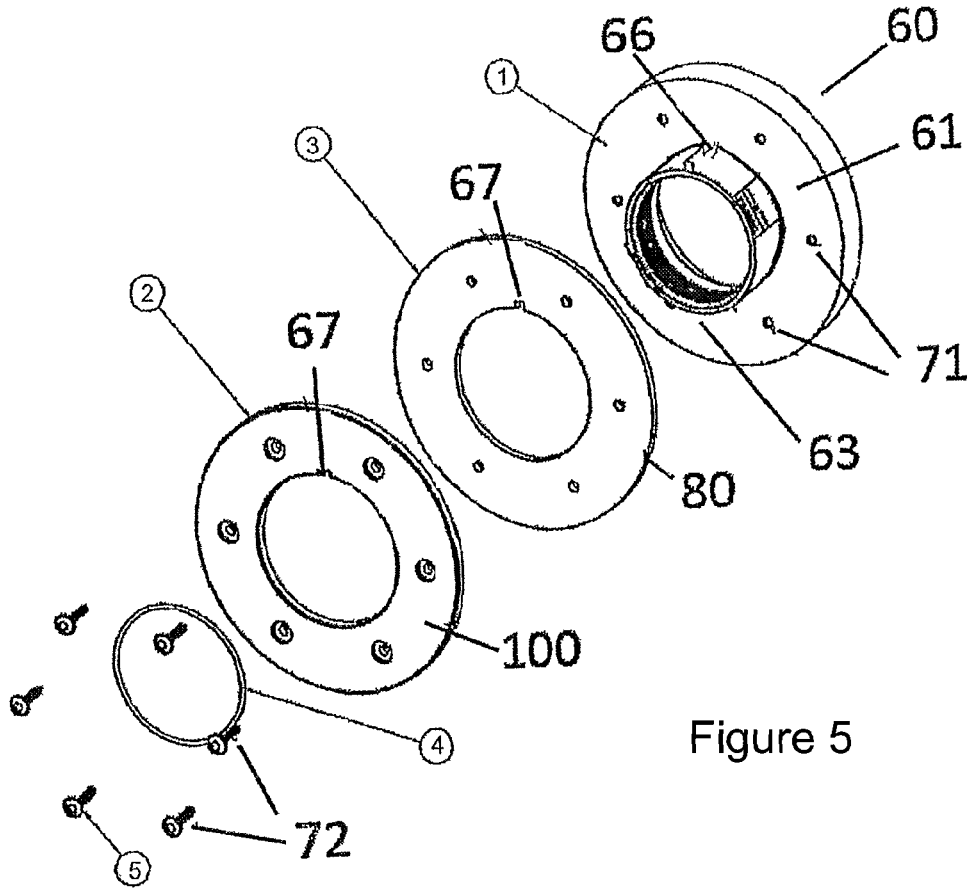
FIG. 5 is an exploded view of another embodiment of a valve sleeve showing the inner flange, gasket and outer flange.

Another embodiment of the valve sleeve is shown in FIG. 5, where comparable parts to that of the sleeve in FIGS. 2-4 are similarly referenced. Shown is the flange area 61 of the valve sleeve, and the valve sleeve extension 63, that will extend through the aligned openings in the flexitank layers and non-woven shell. Gasket 80 is also shown, used to seal the valve sleeve flange area 61 against the interior of the innermost flexitank layer. Outer flange 100 is also shown. In this embodiment, anti-scalloping is not shown on the valve sleeve 60. Also, in this embodiment, the valve sleeve extension 63 includes an alignment ridge 66 extending outwardly from the upstanding cylinder area of the valve sleeve extension 63. The gasket 80 and top flange 100 include a slot 67 that matches the cross section of the alignment ridge 66, to allow for proper alignment of the valve sleeve flange 61, gasket 80 and top flange 100 during assembly. In this embodiment, flange 61 includes openings 71 to accommodate self-tapping screws 72. The openings 71 are not cut through the flange body 61, and hence, no separate screw or bolt gasket is needed. Openings to accommodate the screws or bolts are present in the gasket 80 and top flange 100.

In this fashion, all fabric layers are sandwiched between the two flanges and the non-woven layer 5 is not exposed to any fluids stored in the flexitank, thereby preventing wicking action through the valve sleeve to the outer fabric. A closable valve (such as a ball valve), is then sealing attached to the upstanding sleeve 63, completing the assembled flexitank (not shown).

As described, the straps 7 in this design are not attached between the bladder and the container wall, as shown in the U.S. Pat. No. 6,626,312. The strap-container wall attachment described in the '312 patent restrains movement of the bladder with respect to the container, placing unneeded stress on the bladders (at the point of strap attachment) not present in the present design. The use of straps in this embodiment is to restrain deformation of the bag exterior, in particular, deformation along the top of the flexitank. The straps restrain movement of the bag surface, thereby damping internal wave action of fluids in the interior of the bag.

The invention claimed is:

1. A flexible transport bladder container comprising an first bladder of flexible water proof polymeric material and an enclosing shell of non-woven flexible polymeric material, said transport bladder container having two side portions, two end portions, and a top and a bottom portion, said enclosing shell forming an interior and said first bladder positioned in said interior, a valve sleeve extending through said first bladder and said enclosing shell, said enclosing shell formed from separate top and bottom shell material portions, said top and bottom shell material portions joined together along a perimeter of the bladder's side portions forming side seams having an outer edge, said side seams extending along the perimeter of the bladder's side portions, said side seams are formed with exterior tab portions that extend beyond the seams; and a plurality of straps having a first end and a second end, said first end attached to said tab portion on one side of said transport bladder container, said second end attached to said tab portion on the other side of said transport bladder container, said straps extending across said top portion and spaced apart on said top portion, but not otherwise directly attached to said top portion or said side portion of said transport bladder.

2. The flexible transport container of claim 1 wherein said non-woven flexible polymeric material comprises non-woven polypropylene.

3. The flexible transport container of claim 2 wherein said straps are constructed of woven polyester.

4. The flexible transport bladder container of claim 1 wherein said first bladder is not directly attached to said non-woven outer shell other than at said valve sleeve.

5. The flexible transport bladder container of claim 1 further comprising a second bladder of flexible polymeric material, said second bladder positioned in an interior of said first bladder, said valve sleeve extending through said second bladder.

6. The flexible transport container of claim 5 wherein said first and second bladders are directly attached only at said valve sleeve.

* * * * *